United States Patent [19]

Uemura et al.

[11] Patent Number: 4,738,553

[45] Date of Patent: Apr. 19, 1988

[54] FIXED HEAD THERMAL PRINTER

[75] Inventors: Hisashi Uemura; Kenmei Tanaka, both of Hyogo, Japan

[73] Assignee: Kanzaki Paper Manufacturing Co., Ltd., Tokyo, Japan

[21] Appl. No.: 9,032

[22] Filed: Jan. 29, 1987

Related U.S. Application Data

[63] Continuation of Ser. No. 773,564, Sep. 9, 1985, abandoned.

[30] Foreign Application Priority Data

Sep. 7, 1984 [JP] Japan ..... 59-188455

[51] Int. Cl.[4] ..... B41J 3/02; H05B 1/00

[52] U.S. Cl. ..... 400/120; 346/76 PH; 219/216

[58] Field of Search ..... 400/120; 346/76 PH; 219/216 PH

[56] References Cited

U.S. PATENT DOCUMENTS

| | | | |
|---|---|---|---|
| 4,273,457 | 6/1981 | Noda . | |
| 4,395,146 | 7/1983 | Arai . | |
| 4,447,819 | 5/1984 | Moriguchi et al. | 400/120 |
| 4,524,368 | 6/1985 | Inui et al. | 346/76 PH |
| 4,536,772 | 8/1985 | Isogai | 346/76 PH |

FOREIGN PATENT DOCUMENTS

| | | | |
|---|---|---|---|
| 2069933 | 9/1981 | United Kingdom | 400/120 |

*Primary Examiner*—Eugene H. Eickholt

*Attorney, Agent, or Firm*—Cushman, Darby & Cushman

[57] ABSTRACT

A fixed head thermal printer with a plurality of printing elements defining a line of print. Power is supplied to blocks of elements sequentially with a number of blocks receiving power simultaneously, that number being determined in accordance with the number of dots to be printed. The width of the paper is detected and elements not adjacent the paper are prevented from operating. In one embodiment, slack in a loop of paper from a roll is detected to control the driving speed of the roll.

9 Claims, 5 Drawing Sheets

FIXED HEAD THERMAL PRINTER

This is a continuation of application Ser. No. 773,564, filed Sept. 9, 1985, which was abandoned upon the filing hereof.

BACKGROUND OF THE INVENTION

I. Field of the Invention:

This invention relates to a thermal printing apparatus.

II. Background:

In conventional thermal printers, all heating elements of the printing head are supplied with power in blocks, each block being energized for a certain time. Each such element forms a "dot" which together create patterns perceived as characters. The capacity of the power supply is thus somewhat lowered. All the dot elements are divided into a plurality of blocks with, for instance, 256 elements per block. The capacity of the power supply is then calculated for the worst case condition (printing ratio=100%), and a certain number of blocks can be energized, based on the capacity of the supply. Despite the fact that the mean printing ratio is far lower than the actual one, power is supplied successively on a block-to-block basis because horizontal rule printing can be continuous. Thus, it is possible to increase printing speed somewhat, but this solution is inefficient.

In U.S. Pat. No. 4,447,819, the disclosure of which is expressly incorporated herein by reference, printing speed is increased by determining the number of blocks to be simultaneously energized according to the number of elements to be energized.

In addition, the printing paper used in these conventional fixed head type thermal printers has been limited in the prior art to predetermined widths. It would afford a considerable saving of paper if paper width could be selected according to the printing pattern. However, if such a selection of paper width were available, paper narrower than a particular printing pattern for use could be selected accidentally. In printing a pattern outside the paper width, the heat from the energized heat generating elements is not absorbed by the paper. Thus, the head can be damaged by the so-called "heating-an-empty-oven" phenomenon. Accordingly, such a conventional thermal printer has a disadvantage in that paper of the size fit for a particular printing pattern cannot be selected by the user.

In feeding printing paper in printers, constant speed feeding is normally used. However, it can be time inefficient to feed the paper at the same speed even when a blank portion passes the head in the paper feeding direction. As a result, attempts have been made to feed paper more quickly when a blank portion is detected is the paper feeding direction. If rolled paper is used as printing paper and thus quickly fed in this manner, the speed of rotation of the paper roll must vary as the paper feeding speed changes. If a large diameter paper roll is used, excessive tension may act on the paper because the speed of rotation of the paper roll depends on the paper feeding speed. This occurs because of the force of inertia of the paper roll. On the other hand, excessive paper will be let out when the paper feeding speed is reduced, thus possibly causing the paper to be caught between the paper feeding rollers and lodge therein. In order to eliminate such shortcomings, the paper roll shaft can be equipped with a driver for letting out the paper, and the driver should be so controlled as to follow changes in paper feeding speed. However, addition of such control tends to make printers expensive. Printers using a small diameter paper roll are far simpler in construction, as none of the aforementioned problems is posed. However, because a small diameter roll carries a small quantity of paper, it is necessary for the user to replace the paper roll frequently.

Thus, one object of the present invention is to increase mean printing speed by allowing the number of heating elements (the number of dots) to which power can be supplied simultaneously to be increased or decreased according to the printing ratio on each line. Another object of the present invention is to provide a fixed head type thermal printer wherein thermosensitive elements no longer in contact with the surface of paper as a result of paper width adjustment cannot be erroneously energized. Thus, the thermosensitive elements are prevented from being damaged by heat when narrow printing paper is used.

Another object of the present invention is to provide a relatively inexpensive printer mechanism for feeding printing paper quickly and smoothly at different feeding speeds, without causing excessive tension to be applied to the printing paper even if the paper roll diameter is large.

SUMMARY OF THE INVENTION

In the thermal printer according to the present invention, power is supplied sequentially to blocks of heating elements and simultaneous to a number of blocks, the number being determined in accordance with the number of blocks to be printed. In the second embodiment, the width of the paper is detected and supply of power to elements adjacent space where paper is absent is prevented. The thermal printer also preferably has a manually-operated paper width adjusting mechanism.

In a third embodiment a slack loop is provided in the paper travel path between the roll and elements. The position of a movable bar or the like which moves linearly with the loop is detected to control the speed of the roll driver.

BRIEF DESCRIPTION OF THE DRAWINGS

An exemplary and presently preferred embodiment of the invention will be described in detail with reference to the accompanying drawings, wherein.

DESCRIPTION OF THE PREFERRED EMBODIMENT

Figure 1:
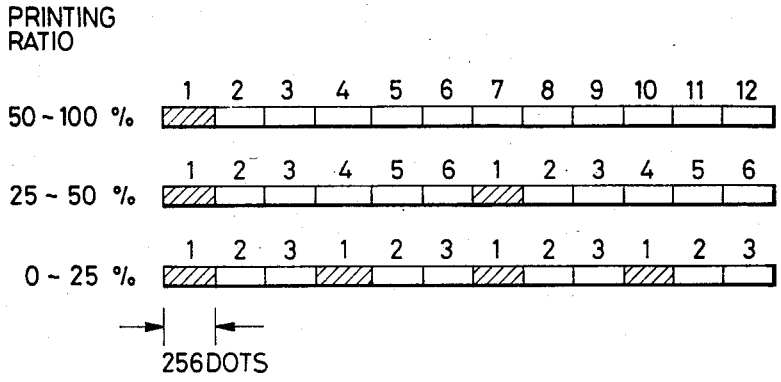
FIG. 1 shows a diagram illustrating the relation between printing ratios and the order in which printing blocks are supplied power.

FIG. 1 shows an example according to the present invention in which heating elements equivalent in length to one line are divided into 256 dots×12 blocks. The numeral on each block represents the order in which power is supplied. For instance, when the printing ratio, which is a ratio of the number of printing elements to the number of dots on a line, is 50–100%, the portion to which power is supplied successively moves from the leftmost portion (marked with slant lines) of the head to the right in order of the numerals. After the rightmost (12th) block is finished, power is then supplied to the leftmost end on the second line. When the printing ratio is 25–50%, two of the leftmost and central blocks are simultaneously supplied with power and two blocks at a time are always supplied with power in order of the numerals. When the printing ratio is 0–25%, four blocks at a time are supplied with power. When the printing ratio is small, e.g., less than 8%, all the blocks may be supplied with power simultaneously. The printing speed can be made to vary at a speed twice or four times higher without significantly changing power consumption, provided that the number of blocks simultaneously energized is increased as the printing ratio decreases.

Figure 2B:
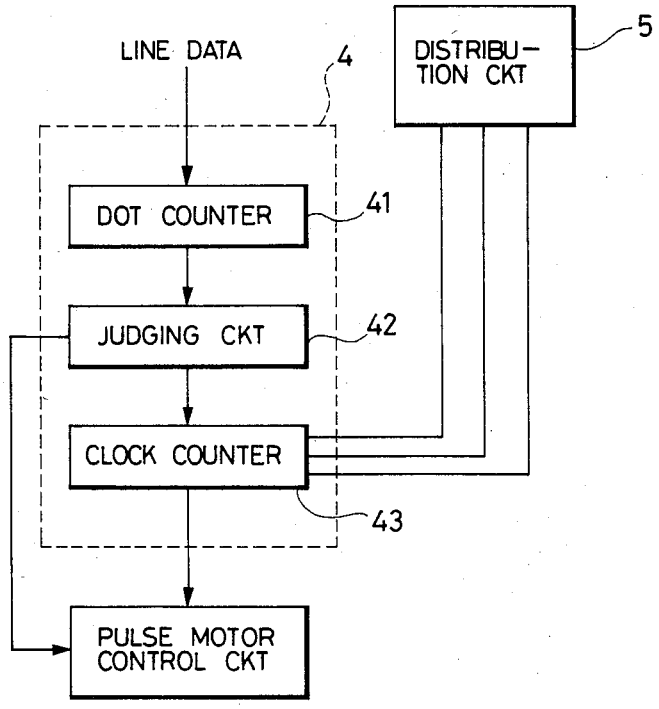
FIG. 2B shows a block diagram of the printing dot number circuit.
Figure 2A:
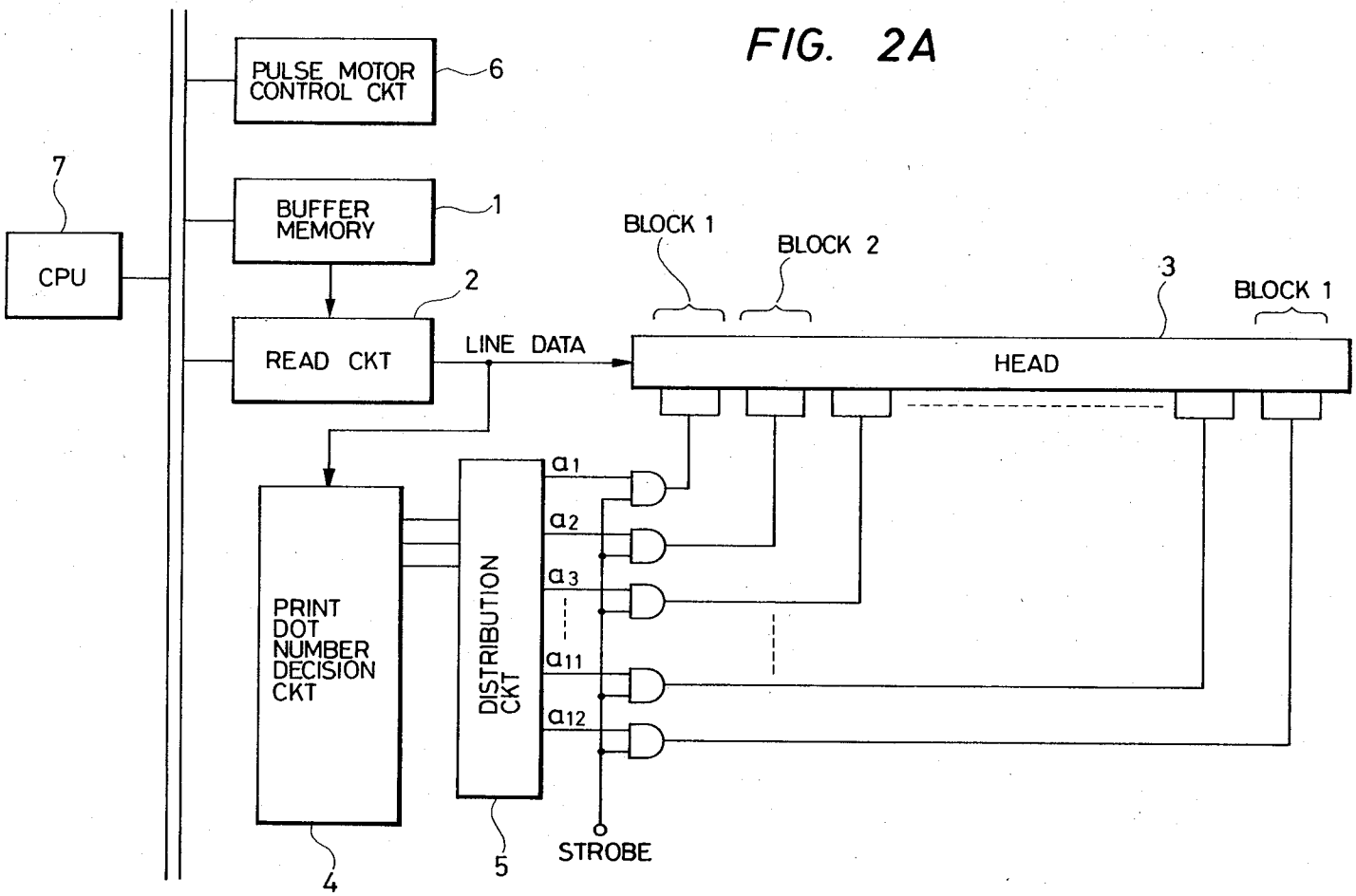
FIG. 2A is a schematic block circuit diagram of a control circuit to control printing ratios.

FIG. 2A shows a schematic block diagram of a thermal printer embodying the technique described in FIG. 1 of the present invention. Printing data stored in a buffer memory 1 is read as line data by a read circuit 2 before transmission to a fixed head 3. The line data is also applied to a printing dot number decision circuit 4. When the number of printing dots is zero, the data is quickly sent and, when non-zero, the data is classified into three ranks of printing ratios as illustrated in FIG. 1 according to the number of printing dots. Decision circuit 4 selectively outputs high-speed, mid-speed or low-speed signals to distribution circuit 5 and further outputs a paper feed instruction signal to pulse motor control circuit 6. Circuit 5 responds by producing outputs successively and simultaneously operating blocks of elements as shown in FIG. 1. CPU 7 conventionally controls flow of information. A voltage from a suitable power supply (not shown) is successively applied to each block of the fixed head, between one and four blocks at a time being supplied with the voltage depending on the printing ratio.

The printing dot number decision circuit 4 will be described with reference to FIG. 2B. As shown in the figure, the decision circuit 4 includes a dot counter 41 for counting the number of printing dots included in one line, a judging circuit 42 for judging the ratio of the printing dots with respect to the number of dots aligned with the printing line, and a clock counter 43 for counting the number of clock pulses during one line printing.

Figure 2C:
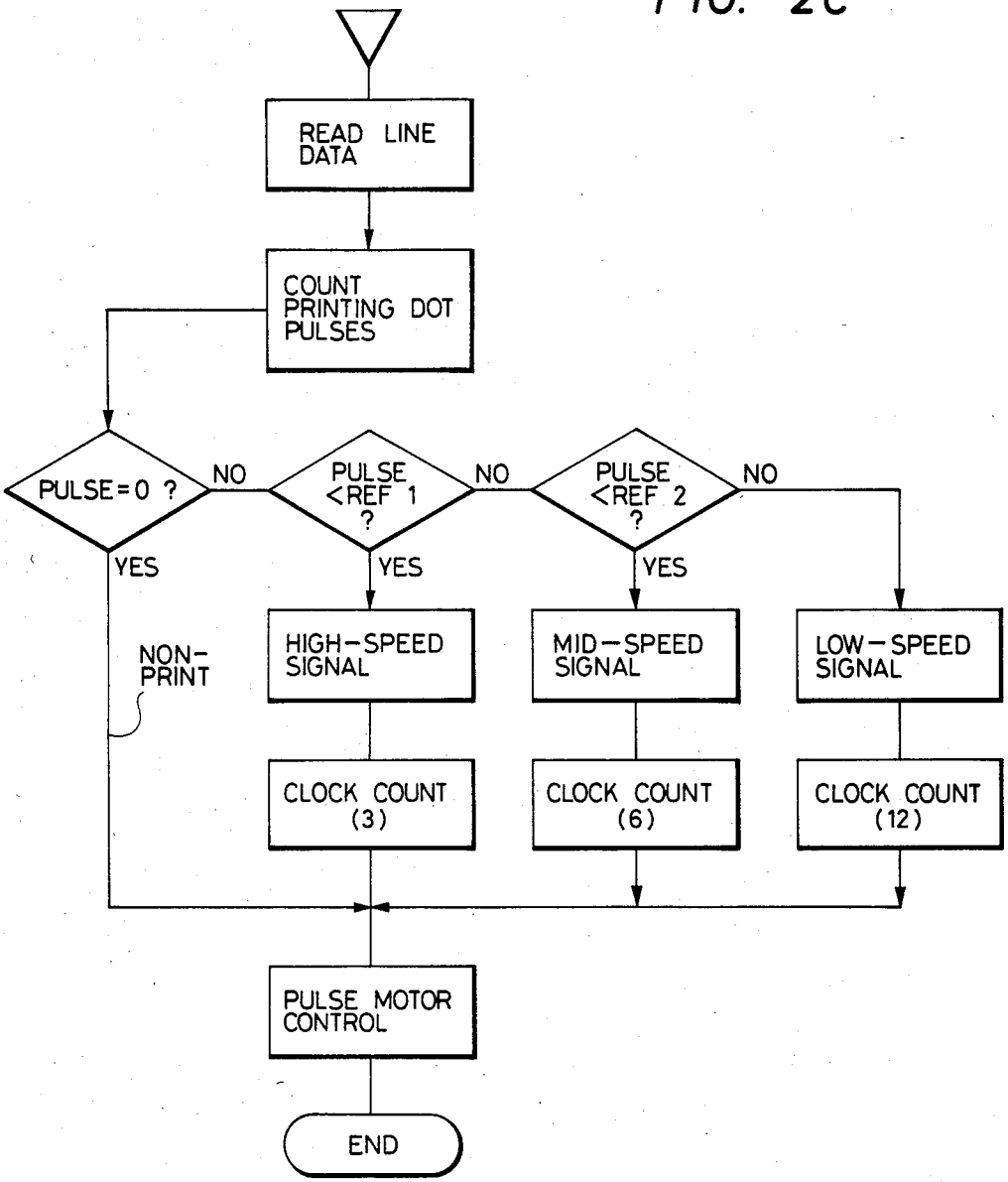
FIG. 2C shows a flow chart.

The operation of the decision circuit 4 shown in FIG. 2B will be described in conjunction with a flow chart shown in FIG. 2C. The line data supplied from the read circuit 2 is applied to the dot counter 41 in which the number of the printing dots is counted. The counted value outputted from the dot counter 41 is supplied to the judging circuit 42. In the judging circuit 42, comparison is sequentially performed. In the first stage, counter value is judged whether it is zero or not. When the counter value is zero indicating non-print state, a paper feed instruction signal is produced from the judging circuit 42 and is applied to the pulse motor control circuit 6. When the counter value is judged to be not zero, then the counter value is compared with a first reference value to judge if the printing ratio is above or below 25%. When the counter value is greater than the first reference value, the counter value is further compared with a second reference value to judge if the printing ratio is above or below 50%.

The result that the counter value is below the first reference value indicates that the printing can be performed at a high speed. Similarly, that the counter value is below the second reference value indicates at a middle speed, and otherwise a low speed. Thus, the high-, mid- and low-speed instruction signals are produced and are applied through a clock counter 43 to the distribution circuit 5.

In the clock counter 43, clock pulses are counted for a period of one line printing. When one line printing is performed at the high speed, the clock counter 43 counts, for example, three; at the middle speed, six; and at the low speed, twelve. From the value of the clock counter 43 and the speed mode instruction signals outputted from the judging circuit 42, printing termination is determined and a signal indicative of the printing termination is sent to the pulse motor control circuit 6. The pulse motor control circuit 6 is enabled in response to the signal sent from the clock counter 43 and causes a pulse motor (not shown) to rotate to thereby feed printing paper and allow the subsequent printing.

Thus, in this fixed head type thermal printer, the heating elements are divided into a plurality of blocks for successively supplying power to each block. The number of printing dots on each line is judged from the input data and the number of blocks to which power is simultaneously supplied depending on the printing ratio is increased or decreased. Printing speed can be increased thereby without the necessity of increasing the capacity of the power supply. When the printing ratio is low, the portion on the right-hand side of printing paper is normally blank. However, if it is so arranged that the blocks to which power is simultaneously supplied are distributed over a line in such a manner to move the electrified portion from the leftmost end to the center and to the right-hand side successively when more than one block is supplied with power, the probability of simultaneously electrifying all dots of the two blocks will be considerably reduced and risk of power consumption exceeding the capacity of the power supply will be minimized. Moreover, if the capacity of the power supply is chosen to be sufficient to continuously supply all dots to one block with power, it will be fully capable of supplying all dots of the plurality of blocks instantaneously and thus safe from being overloaded.

Figure 3:
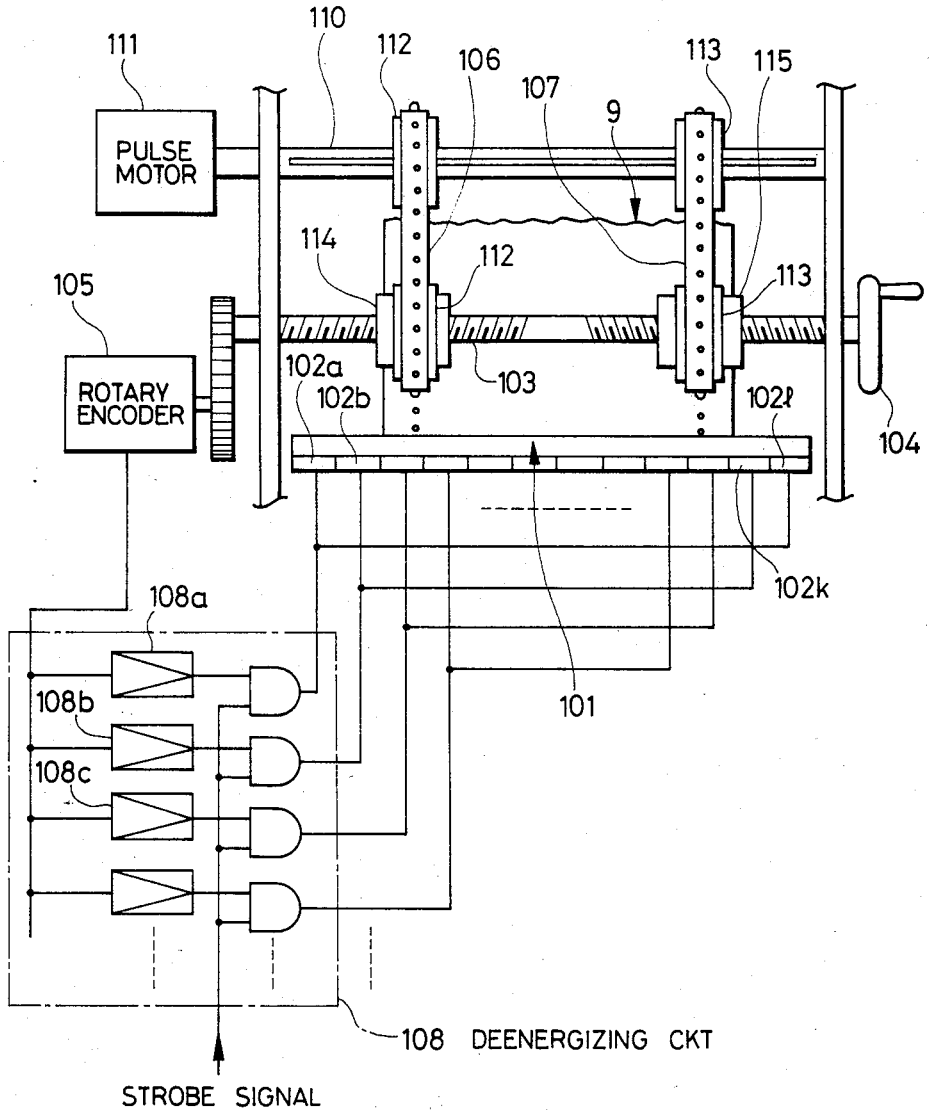
FIG. 3 shows a schematic block diagram illustrating a thermal printer embodying a variable width paper control mechanism.

Referring to FIG. 3, a second embodiment of the invention is shown. This printer embodies a variable width paper feeder. A fixed type head 101 has 256 dots × 12 blocks of heat generating elements, each heat generating element being given a binary data signal and a strobe signal on an element block basis by strobe terminals 102*a*, 102*b* . . . 102*l*. A threaded bar 103 serves as a paper width adjustment means. One end of threaded bar 103 is provided with a handle 104 for turning the bar, and the other end is coupled to a speed reducing mechanism through a rotary encoder 105, which produces an analog signal with a voltage proportional to the angle of rotation of the threaded bar 103. The threads in the right half portion of threaded bar 103 are cut in the opposite direction from the threads in the left half portion thereof. The respective bearing units 114 and 115 of left and right pin tractors 106 and 107 are screwed onto the threaded bars 103, so that the pin tractors 106 and 107 may be moved to the left and right as the threaded bar 103 turns. Units 114 and 115 thus both move inward or outward together. The thermal printer according to this embodiment includes a deenergizing circuit 108 for successively setting the outputs of comparators 108*a*, 108*b*, 108*c* at a level L. The reference levels of comparators 108*a*, 108*b*, 108*c* are consecutively different depending on the analog signal outputted from the rotary encoder 105, and these levels select the blocks 102*a–l* which should be deenergized. A pin tractor driving shaft 110 is driven by a pulse motor 111, and pulleys 112 and 113 are fastened onto the driving shaft 110 and made slidable in the axial direction by a sliding key. The pin tractors 106 and 107 are stretched between pulleys 112 and 113. These pulleys 112 and 113 are rotatably mounted on the peripheral faces of the bearing units 114 and 115 which are rigidly screwed into the threaded bar 103.

Assuming that printing paper has the width shown in FIG. 3, the blocks 102*a*, 102*b* and 102*k*, 102*l* must be prevented from being energized to avoid the "heating an empty oven" effect. If the handle 104 is turned to move the pin tractors 106, 107 to the position where they mate with pin holes of printing paper 9, the rotary encoder 105 will detect the then quantity of rotation of the threaded bar 103, and convert the quantity to an analog signal. This signal is used in deenergizing circuit 108 for selecting blocks to be deenergized. In this case, the outputs of the comparators 108*a* and 108*b* are set at the level L. The strobe signals directed to the blocks 102*a*, 102*l* at both ends of the maximum printing width are terminated by means of comparator 108*a*, and the blocks 102*b* and 102*k* by comparator 108*b*. Thus, the blocks 102*a*, *b*, *l* and *k* cannot be energized when this smaller paper is used.

Although the left and right portions of bar 108 are inversely threaded to adjust paper width with horizontal symmetry so as to deenergize the blocks symmetrically positioned, it is acceptable to deenergize the blocks positioned only on the right end side by making only the pin tractor 107 on the right-hand side movable, thus putting the printing paper on the left-hand side.

Thus, the heat generating elements are prevented from being energized to the extent that paper width is decreased. The quantity of adjustment given by the paper width adjusting means is detected according to this embodiment and the heat generating elements not in touch with the printing paper are prevented from being energized accidentally. Accordingly, the heat generating elements are prevented from being damaged and their life will not be shortened. Therefore, paper width may freely be selected depending on a particular printing pattern for use and thus printing paper consumption can be minimized.

In a fixed head type thermal printer, because a large capacity power source for energizing heat generating elements has been required if all the heat generating elements making up the thermal head are arranged to be simultaneously energized, the group of heat generating elements is divided into a plurality of blocks and they are successively energized on a block basis to make the power source compact as previously described. The time thus required to complete a printing equivalent to a line in the dot arrangement of the printing pattern becomes the product of (time required to energize on block)× (number of blocks). Thus, the printing speed will be further reduced. The number of blocks to be energized will decrease if paper is set narrower depending on the purpose Of use, and the printing speed will be increased to that extent, so that not only the economization of printing paper consumption but also improvement in printing efficiency can be accomplished.

Figure 4:
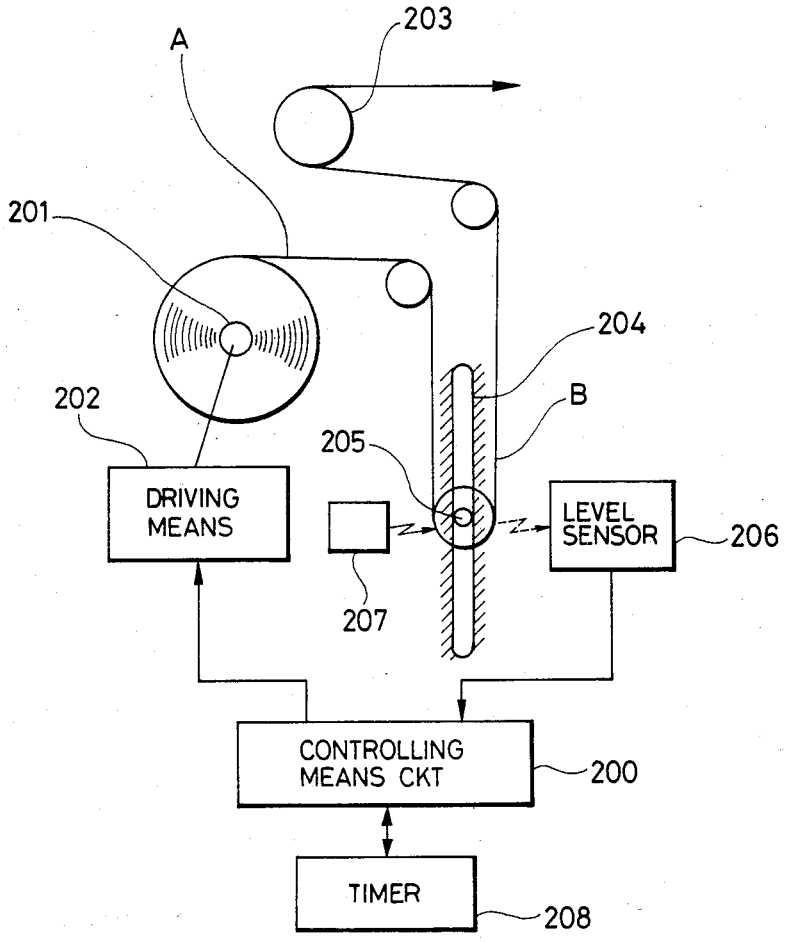
FIG. 4 shows a schematic side view of a thermal printer using a quick rolling paper feeder of the present invention.

Referring to FIG. 4, a third embodiment of the present invention can be seen. This embodiment shows an example of the application of a quick rolling feeding printer to a label printer of the heat transfer recording type. Driver 202 is capable of varying the speed of rotation of a rotary shaft 201 which draws out rolled paper in two stages. High and low speeds are available from the rotary shaft 201. It is so arranged that printing paper A feeding may be switched from normal feeding speed to quick feeding speed by a paper feeder (either by friction or pin feeding) and a control circuit 200 depending on the printing pattern. The paper A Is driven down between the rotary shaft 201 and a platen roller 203 by its own weight or by a spring, and a moving bar 205 is provided which is vertically movable along a guide groove 204. Moving paper A moves around bar 205, in such a way to provide a slack portion B. Moving bar 205 may be alternatively rotatably supported by a lever instead of guide groove 204. The distance moved by bar 205, that is, the slack of the printing paper, is photoelectrically detected by an optical sensor 206 which receives light from a source 207. When the amount of slack is small, the driver is kept rotating at high speed. The rotation of the driver 202 is switched to a low speed when the light to the sensor 206 is cut off by bar 205, thus indicating the slack exceeds a predetermined value.

A timer 208 is included to prevent spurious values from being detected. Thus, once the rotation of driver 202 is switched over to high speed, rotary shaft 201 is made to rotate at high speed for a certain time even if light is cut off. Given that the paper is fed to the platen at a mean speed of Vm of a mixture of high and low speeds, the quantity of paper let out by the driver 202 at high speed operation is V′, V′ being greater than Vm. The timer 208 is set for a time T. A means maximum value of the quantity of slack when paper is moved down and located lower than the sensor 206 is $(V'-Vm)\times T$. High and low paper feeding speeds are Vh and V, respectively, and thus the change in the quantity of the slack ranges from $(V'-Vu)\times T$ to $(V'-Vh)\times T$ while centering on the mean value above. Since V′ is large when the diameter of the paper roll is large, the quantity of the slack is usually large and the driver 202 usually remains in the low speed state in terms of the time ratio. As the diameter of the paper roll decreases, the mean quantity of the slack also reduces and the driver 202 increasingly operates at a higher rate speed rate.

The quantity of the printing paper let out of the paper roll becomes small as the diameter of the paper roll decreases, even when the speed of rotation of the rotary shaft 201 is constant. The driver 202 for letting out the rolled paper is set so that the paper is drawn out at a speed slightly higher than that at the platen when the diameter of the paper roll gets smaller at high speed operation. Thus, although the driver may properly be set at low speed, it is necessary in this embodiment that the quantity of the paper drawn out allow the speed at which the paper is fed to the platen to be maximized even when the diameter of the paper roll is large. The reason for this is that, because there is provided only one sensor 206 for detecting the slack and both upper and lower limits of the quantity of the slack are not regulated, the quantity of the slack will increase to some extent if normal feeding operation continues for a long period of time. The speed of the driver 202 at low speed operation may simply be reduced to zero, or stopped.

Although the printing paper A is slackened by stretching it over the moving bar 205, it is intended to give necessary and constant tension to the paper A at the platen by stabilizing the slack portion thereof. Bar 205 is thus unnecessary if proper guide walls for housing the slack portion and means for providing proper tension are separately provided. Moreover, the low speed of the driver 202, previously referred to, includes interrupted operation. The sensor 206 may be installed in two upper and lower stages so as to regulate the upper and lower limits of the slack, and the timer 208 is not needed in this case.

In operation, the rolled paper driver is controlled by detecting the quantity of movement of the moving bar for slackening printing paper, so that the quantity of the paper required for quick paper feeding can be dealt with by the slack. The advantage is that smooth paper feeding is facilitated because the paper is prevented from resisting against being fed as tension is applied to the rolled paper when it is fed at high speed. Moreover, the roller paper driving motor is kept operating while the paper is being fed, provided that the rotation of the rolled paper is made switchable from high to low speed by interlocking the rolled paper driven with the paper feeder, making the rotation of the driver switchable in two stages and utilizing the aforesaid detected output. Further, because it need not be started each time insufficiency of the slack is detected, the capacity of the motor can be made small and the required quantity of the slack can be set small as speed responding to the rolled paper being drawn out; in other words, the printer can be made compact.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A fixed head type thermal printer comprising:

a plurality of dot printing elements defining a line of print;

means for moving paper past said elements for printing with said elements being positioned adjacent said paper;

means for supplying power sequentially to blocks of said elements;

means for controlling said supplying means to supply power sequentially to said blocks and simultaneously to a number of said blocks, said number being increased as the ratio of the number of printing elements to the number of dots on a line is decreased, and said number being decreased as said ratio is increased.

2. A printer as in claim 1 including:

means for detecting the width of said paper moving past said elements; and means for preventing supply of power to elements positioned adjacent a space in which said paper is absent.

3. A printer as in claim 2 wherein said moving means includes a first shaft having first and second pulleys thereon for driving said paper, a pulse motor for driving said shaft, a second threaded shaft spaced from said first shaft with first and second pulleys thereon and handle means for manually rotating said second shaft to move said pulleys thereon inward and outward, respectively, to fit any width of paper, wherein said detecting means includes a rotary encoder for producing a signal indicating the rotations of said second shaft and thus the width of said paper and wherein said controlling means includes circuit means for receiving said signal and controlling supply of power in accordance therewith.

4. A printer as in claim 3 further including means for fixing said elements adjacent said second shaft.

5. A printer as in claim 1 further including means for supplying paper from a roll of paper.

means for driving said roll at least at high and low speeds to unroll said paper, a plurality of rollers defining a paper travel path to said elements including a loop with a slack portion, means linearly movable with said loop, and means for detecting the position of said movable means and controlling said roll driving means in accordance therewith.

6. A printer as in claim 5 wherein said detecting means includes a light source and an optical sensor and said movable means includes a bar mounted therebetween for movement with said loop.

7. A printer as in claim 5 wherein said controlling means includes a timer for causing said driving means to thereafter drive at a high speed for a set time after said controlling means causes said driving means to begin driving at said high speed.

8. A fixed head type thermal printer comprising:

a plurality of dot printing elements defining a line of print;

means for moving paper past said elements for printing with said elements being positioned adjacent said paper, said moving means including, a first shaft having first and second pulleys for driving said paper, a pulse motor for driving said shaft, a second threaded shaft spaced from said first shaft having first and second pulleys, and handle means for manually rotating said second shaft to move said pulleys thereon inward and outward, respectively, to fit any width of paper;

means for supplying power sequentially to blocks of said elements;

means for controlling said power supplying means to supply power sequentially to said blocks and simultaneously to a number of said blocks, said number being determined in accordance with the number of dots to be printed, said controlling means having circuit means for receiving said signal and controlling said supply of power in accordance therewith;

means for detecting the width of said paper moving past said elements, said detecting means including a rotary encoder for producing a signal indicating the rotations of said second shaft and thus the width of said paper; and means for preventing the supply of power to elements positioned adjacent to space in which said paper is absent.

9. A printer as in claim 8 further including means for fixing said elements adjacent said second shaft.

* * * * *